US005944120A

United States Patent [19]

Barden

[11] Patent Number: 5,944,120

[45] Date of Patent: Aug. 31, 1999

[54] HYDRAULIC HAMMER ASSEMBLY HAVING LOW VIBRATION CHARACTERISTICS

[75] Inventor: William Mark Barden, Raleigh, N.C.

[73] Assignee: Caterpillar Inc., Peoria, Ill.

[21] Appl. No.: 08/966,927

[22] Filed: Nov. 10, 1997

[51] Int. Cl.[6] ..... B25D 9/00

[52] U.S. Cl. ..... 173/212; 173/206; 173/138; 173/135

[58] Field of Search ..... 173/206, 207, 173/208, 212, 138, 135, 137, 222

[56] References Cited

U.S. PATENT DOCUMENTS

| | | | |
|---|---|---|---|
| 3,739,863 | 6/1973 | Wohlwend . | |
| 4,073,350 | 2/1978 | Eklöf et al. . | |
| 4,165,788 | 8/1979 | Montabert . | |
| 4,484,638 | 11/1984 | West . | |
| 4,741,404 | 5/1988 | Oyama . | |
| 4,825,960 | 5/1989 | Krone . | |
| 4,871,035 | 10/1989 | Ekwall | 173/139 |
| 5,267,726 | 12/1993 | Takeo et al. . | |
| 5,273,262 | 12/1993 | Baldini et al. . | |
| 5,325,929 | 7/1994 | Sippus et al. . | |
| 5,370,193 | 12/1994 | Sippus et al. . | |
| 5,419,404 | 5/1995 | Niemi et al. . | |
| 5,520,254 | 5/1996 | Weber | 173/128 |

*Primary Examiner*—Linda Johnson
*Assistant Examiner*—Matthew Luby
*Attorney, Agent, or Firm*—Paul J. Maginot

[57] ABSTRACT

A hammer assembly which decreases the severity of impact shocks generated by the hammer assembly during operation thereof is disclosed. The hammer assembly includes a housing defining a chamber. The housing further defines an injector port and an exhaust port each being in fluid communication with the chamber. The hammer assembly further includes a work tool positioned in the chamber, a piston positioned within the chamber, a first hydraulic pressure source which moves the piston in a work stroke toward the work tool, a second hydraulic pressure source which moves the piston in a return stroke away from the work tool, and a damping fluid source in fluid communication with the injector port. The hammer assembly still further includes a first valve which allows damping fluid to be advanced from the damping fluid source and into the chamber during the work stroke, and prevents damping fluid from being advanced from the damping fluid source and into the chamber during the return stroke. The hammer assembly yet further includes a second valve which allows damping fluid to be advanced out of the chamber through the exhaust port during the return stroke, and prevents damping fluid from being advanced into the chamber through the exhaust port during the work stroke. A method of reducing vibrations in a hammer assembly is also disclosed.

15 Claims, 4 Drawing Sheets

HYDRAULIC HAMMER ASSEMBLY HAVING LOW VIBRATION CHARACTERISTICS

TECHNICAL FIELD OF THE INVENTION

The present invention relates generally to a hammer assembly, and more specifically to a hydraulic hammer assembly having low vibration characteristics.

BACKGROUND OF THE INVENTION

Heavy work machines, such as backhoes or excavators, are used on work sites. These machines are generally used for digging and moving dirt. On a number of occasions, there is a need to break up large hard objects before such objects can be moved away. In particular, a work site may contain a variety of materials such as rock, concrete, asphalt, or other hard objects. Backhoes or excavators equipped with commonly mounted implements, such as buckets or blades, may not be able to effectively break up this type of material.

In order to break up such material, the backhoe or excavator may have a powered hammer assembly secured thereto. Typically, the hammer assembly will be powered by either a hydraulic or pneumatic pressure source. During a work or power stroke, high fluid pressure is applied to a first shoulder of a piston, thereby driving the piston in a forward direction. The piston then strikes a hammer, which is driven in the forward direction thereby causing a work tip of the hammer to strike the rock, concrete, asphalt or other hard object to be broken up.

During a return stroke, fluid pressure is applied to a second shoulder of the piston in order to return the piston to its original position. At the end of the return stroke, travel of the piston is restricted or otherwise limited by a contact surface, commonly referred to as a stop. The stop is positioned in a predetermined location in order to properly position the piston for a subsequent work stroke.

When the piston impacts or otherwise contacts the stop, an impact shock is generated. Such an impact shock is transmitted through the powered hammer assembly to the backhoe or excavator. During operation of the powered hammer, the piston is commonly cycled at a rate of up to several hundred work strokes per minute, thereby generating several hundred impact shocks per minute. Hence, during a given work operation a large number of impact shocks are then transmitted through the powered hammer assembly to the backhoe or excavator.

Generation of these impact shocks has several disadvantages associated therewith. For example, the impact shocks are transmitted through the mechanical structure of the backhoe or excavator to a cab which houses an operator, thereby potentially inconveniencing the operator. Moreover, the transmission of the impact shocks through the mechanical structure of the backhoe or excavator, may potentially reduce the useful life of the components associated with the backhoe or excavator.

What is needed therefore is an apparatus and method for decreasing the severity of impact shocks generated by the operation of powered hammers that may be attached to heavy machinery which overcome one or more of the above-mentioned drawbacks.

SUMMARY OF THE INVENTION

In accordance with a first embodiment of the present invention, there is provided a hammer assembly which includes a housing defining a chamber. The housing further defines an injector port and an exhaust port each being in fluid communication with the chamber. The hammer assembly further includes a work tool positioned in the chamber, a piston positioned within the chamber, a first hydraulic pressure source which moves the piston in a work stroke toward the work tool, a second hydraulic pressure source which moves the piston in a return stroke away from the work tool, and a damping fluid source in fluid communication with the injector port. The hammer assembly still further includes a first valve which allows damping fluid to be advanced from the damping fluid source and into the chamber during the work stroke, and prevents damping fluid from being advanced from the damping fluid source and into the chamber during the return stroke. The hammer assembly yet further includes a second valve which allows damping fluid to be advanced out of the chamber through the exhaust port during the return stroke, and prevents damping fluid from being advanced into the chamber through the exhaust port during the work stroke.

In accordance with a second embodiment of the present invention, there is provided a hammer assembly including a housing defining a chamber. The housing further defines an injector port and an exhaust port each being in fluid communication with the chamber. The hammer assembly further includes a work tool positioned in the chamber, a piston positioned within the chamber, a first source of pressurized hydraulic fluid which moves the piston in a work stroke toward the work tool, and a second source of pressurized hydraulic fluid which moves the piston in a return stroke away from the work tool. The hammer assembly still further includes a damping hydraulic fluid source in fluid communication with the injector port. The hammer assembly yet further includes a first check valve which allows damping hydraulic fluid to be advanced from the damping hydraulic fluid source and into the chamber during the work stroke, and prevents damping hydraulic fluid from being advanced from the damping hydraulic fluid source and into the chamber during the return stroke. The hammer assembly still further includes a second check valve which allows damping hydraulic fluid to be advanced out of the chamber through the exhaust port during the return stroke, and prevents damping hydraulic fluid from being advanced into the chamber through the exhaust port during the work stroke.

In accordance with a third embodiment of the present invention, there is provided a method of reducing vibrations in a hammer assembly. The hammer assembly includes a housing defining a chamber. The housing further defines an injector port and an exhaust port each being in fluid communication with the chamber. The hammer assembly still further includes a work tool positioned in the chamber, a piston positioned within the chamber, a first hydraulic pressure source which moves the piston in a work stroke toward the work tool, a second hydraulic pressure source which moves the piston in a return stroke away from the work tool, a damping fluid source in fluid communication with the injector port, a first valve which is interposed between the injector port and the damping fluid source, and a second valve which is in fluid communication with the exhaust port. The method includes step of allowing damping fluid to be advanced from the damping fluid source and into the chamber during the work stroke via the first valve. The method further includes the step of preventing damping fluid from being advanced from the damping fluid source and into the chamber during the return stroke via the first valve. The method still further includes the step of allowing damping fluid to be advanced out of the chamber through the exhaust port during the return stroke via the second valve. The method yet further includes the step of preventing damping fluid from being advanced into the chamber through the exhaust port during the work stroke via the second valve.

BEST MODE FOR CARRYING OUT THE INVENTION

Figure 1:
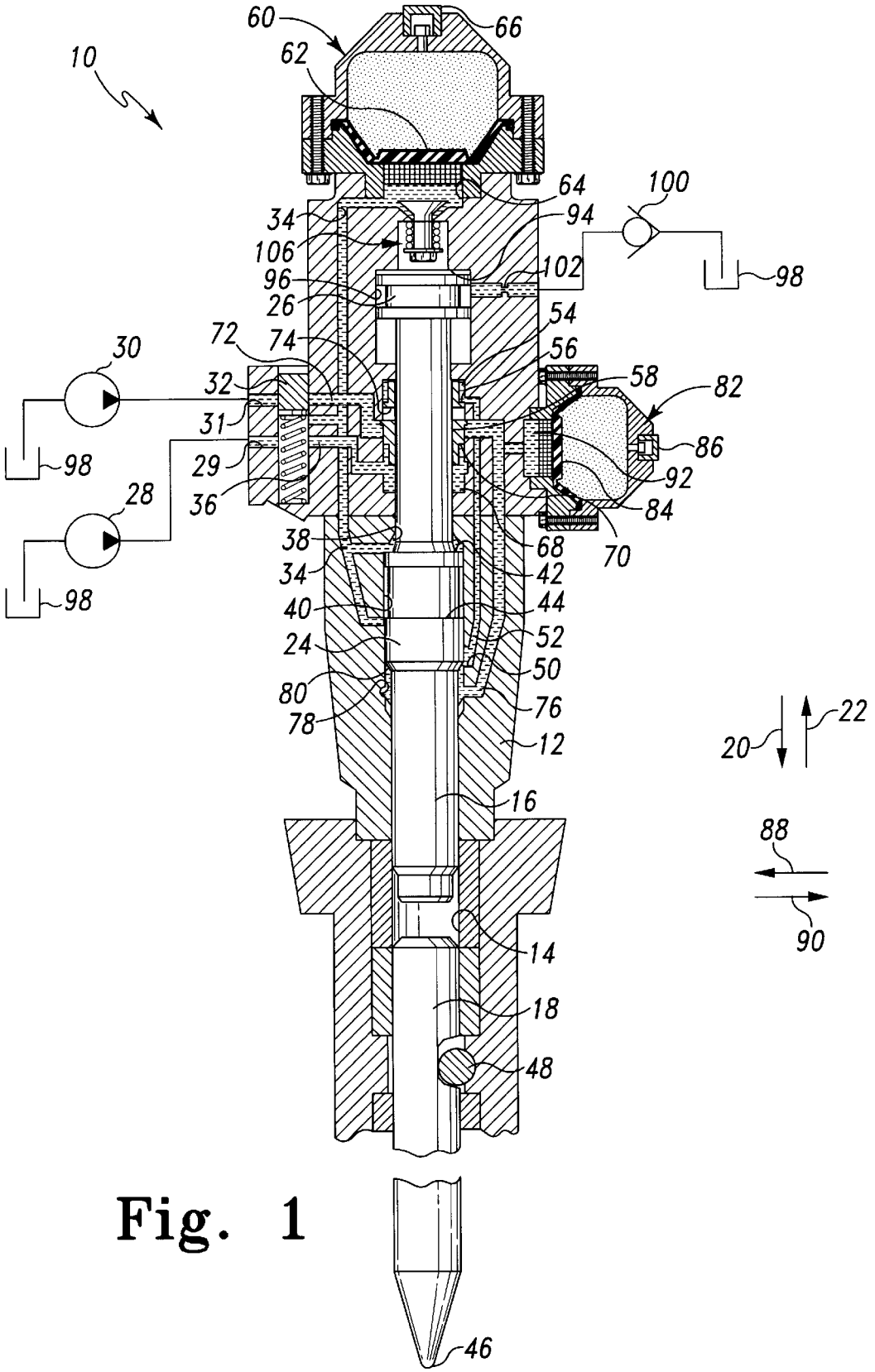
FIG. 1 is shown a cross sectional view of a hammer assembly 10 at the beginning of a work stroke, which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
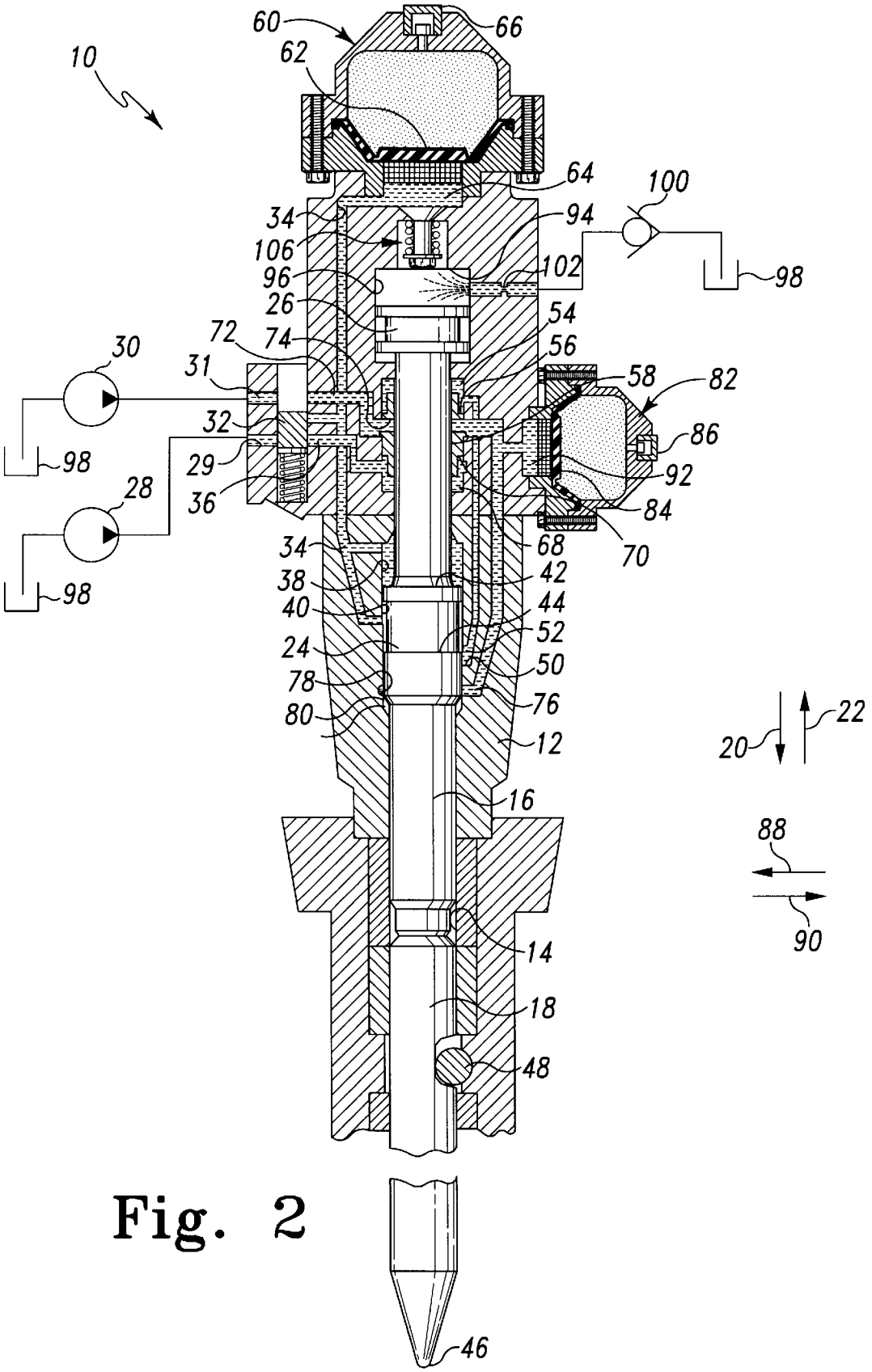
FIG. 2 is view similar to FIG. 1 but showing the hammer assembly 10 at the end of a work stroke.

Referring now to FIGS. 1 and 2, there is shown a cross sectional view of a hammer assembly 10, such as a hydraulic hammer, which may be attached to a backhoe or excavator (not shown). The hammer assembly 10 includes a housing 12, a chamber 14 defined in the housing 12, a piston 16, and a work tool 18. The piston 16 is operatively housed in the chamber 14 such that the piston 16 can translate in the general direction of arrows 20 and 22. In particular, during a work stroke, the piston 16 moves from a first piston position as shown in FIG. 1 in the general direction of arrow 20 to a second piston position as shown in FIG. 2 so as to strike the work tool 18. Conversely, during a return stroke, the piston 16 moves from the second piston position as shown in FIG. 2, to the first piston position as shown in FIG. 1 in the general direction of arrow 22.

The piston 16 includes a work portion 24 and a load portion 26. Pressurized fluid is advanced against the work portion 24 to urge the piston 16 from the first piston position to the second position during the work stroke. Similarly, pressurized fluid is advance against the work portion 24 to return the piston 16 from the second piston position to the first piston position during the return stroke. As the piston 16 moves in the general direction of arrow 22, the piston 16 strikes the housing 12 thereby creating an impact shock. Pressurized fluid is advanced against the load portion 26 to decrease the severity of the impact shock generated as the piston 16 is moved in the general direction of arrow 22 during the return stroke.

The hammer assembly 10 further includes a first inlet 29 which is coupled to a first hydraulic pressure source 28, and a second inlet 31 which is coupled to a second hydraulic pressure source 30. The first hydraulic pressure source 28 provides the energy used during the work stroke to move the piston 16 from the first piston position to the second piston position, whereas the second hydraulic pressure source 30 provides the energy used during the return stroke to move the piston 16 from the second piston position to the first piston position. The hammer assembly 10 further includes a control valve 32. The control valve 32, is used to selectively place either the first pressure source 28 or the second pressure source 30 in fluid communication with the chamber 14.

During the work stroke, the control valve 32 places the first hydraulic pressure source in fluid communication with the passages 34 and 36 as shown in FIG. 1. Pressurized fluid from the first hydraulic pressure source 28 is advanced to an area 38 and an area 40 via the passage 34. As pressurized fluid fills the area 38, it acts upon a shoulder 42 defined on the piston 16. In particular, the force of the pressurized fluid on the shoulder 42 drives the piston 16 in the general direction of arrow 20. Similarly, as pressurized fluid fills the area 40, it acts upon a shoulder 44 defined on the piston 16. In particular, the force of the pressurized fluid on the shoulder 44 drives the piston 16 in the general direction of arrow 20. Thus, when the control valve 32 places the first hydraulic pressure source 28 in fluid communication with the passage 34, pressurized fluid is applied to both the shoulder 42 and the shoulder 44 so as to drive piston 16 in the general direction of arrow 20.

The passage 34 is also in fluid communication with an accumulator 60. The accumulator 60 includes a bladder 62 with a compressed gas such as nitrogen therein. The compressed gas is introduced through a gas coupling 66. The gas exerts an accumulator pressure in a downward direction in the general direction of arrow 20 on the fluid within an area 64 of the accumulator 60 thereby urging the pressurized fluid into the passage 34. Hence, if the accumulator pressure is greater than the pressure in passage 34, the fluid is transmitted from the area 64 of the accumulator 60 to the passage 34. If the pressure in passage 34 is greater than the accumulator pressure, the fluid is transmitted from the passage 34 to the area 64 of the accumulator 60 thereby allowing the accumulator 60 to absorb excess hydraulic energy from the first hydraulic pressure source 28.

The passage 36 is also placed in fluid communication with the first hydraulic pressure source 28 when the control valve 32 is positioned for the work stroke. Pressurized fluid is advanced from the passage 36 to the area 68. The pressurized fluid in the area 68 acts upon a sleeve valve 58. In particular, the pressurized fluid in area 68 acts upon a surface 70 of the sleeve valve 58 in order to urge the sleeve valve 58 in the general direction of arrow 22 as shown in FIG. 1.

Near the end of the work stroke, the piston 16 strikes the work tool 18. The work tool 18 includes a tip 46 and a retainer 48. The retainer 48 limits the movement of the work tool 18, and thus the piston 16 in the general direction of arrow 20. Removing the retainer 48 allows a variety of work tools 18 with different configurations of the tip 46 to be attached to the hammer assembly 10. As the piston 16 strikes the work tool 18, the force of the piston 16 is transmitted through the work tool 18 to the tip 46 in the general direction of arrow 20. Moreover, this force is applied to a hard object such as rock, concrete, or asphalt in order to break up the hard object.

Also, near the end of the work stroke, as the piston 16 moves in the general direction of arrow 20, an area 50 is placed in fluid communication with the area 40 (see FIG. 2) so as to cause pressurized fluid to advance to the area 50. From the area 50, pressurized fluid is then advanced to an area 54 via a passage 52 in the general direction of arrow 22. The pressurized fluid in the area 54 acts upon the sleeve valve 58. In particular, the pressurized fluid in area 54 acts upon a surface 56 of the sleeve valve 58 in order to urge the sleeve valve 58 in the general direction of arrow 20 as shown in FIG. 2.

To begin the return stroke, the control valve 32 isolates the first hydraulic pressure source 28 from the passages 34 and 36, and causes fluid pressure from the second hydraulic pressure source 30 to act upon the piston 16. In particular, the control valve 32 places the second hydraulic pressure source 30 in fluid communication with a passage 72, and isolates the first hydraulic pressure source 28 from passages 34 and 36.

As pressure from the first hydraulic pressure source 28 is isolated from the passage 36, the pressure in area 68 drops allowing pressure in the area 54 to urge the sleeve valve 58 in the general direction of arrow 20. In particular, the pressure of fluid in area 54 acting on the surface 56 overcomes the reduced pressure of fluid in the area 68 acting on surface 70 thereby urging the sleeve valve in the general direction of arrow 20. As the sleeve valve moves in the general direction of arrow 20, a sleeve valve passage 74 defined in the sleeve valve 58 places the passage 72 in fluid communication with a passage 76.

The pressurized fluid from the passage 72 is advanced through the sleeve valve passage 74, through the passage 76 and to the area 78. As the pressurized fluid fills the area 78, it acts upon the piston 16. In particular, the pressurized fluid in area 78 acts upon a shoulder 80 of the piston 16 so as to drive the piston 16 in the general direction of arrow 22. This moves the piston 16 from the second piston position as shown in FIG. 2 to the first piston position as shown in FIG. 1.

The passage 76 is also in fluid communication with an accumulator 82. The accumulator 82 includes a bladder 84 with a compressed gas such as nitrogen therein. The compressed gas is introduced through a gas coupling 86. The gas exerts an accumulator pressure in the general direction of arrow 88 on the fluid within an area 92 of the accumulator 82 thereby urging the pressurized fluid into the passage 76. Hence, if the accumulator pressure is greater than the pressure in passage 76, the fluid is transmitted from the area 92 of the accumulator 82 to the passage 76. If the pressure in the passage 76 is greater than the accumulator pressure, the fluid is transmitted from the passage 76 to the area 92 of the accumulator 82 thereby allowing the accumulator 82 to absorb excess hydraulic energy from the second hydraulic pressure source 30.

At the end of the work stroke, the piston 16 is driven in the general direction of arrow 22 until it strikes a contact surface 94 of the housing 12. The piston 16 striking the contact surface 94 creates an impact shock which is transmitted through the hammer assembly 10 to the backhoe or excavator (not shown). After striking the contact surface 94, the piston 16 is positioned in the first piston position for a subsequent work stroke as shown in FIG. 1.

Figure 3:
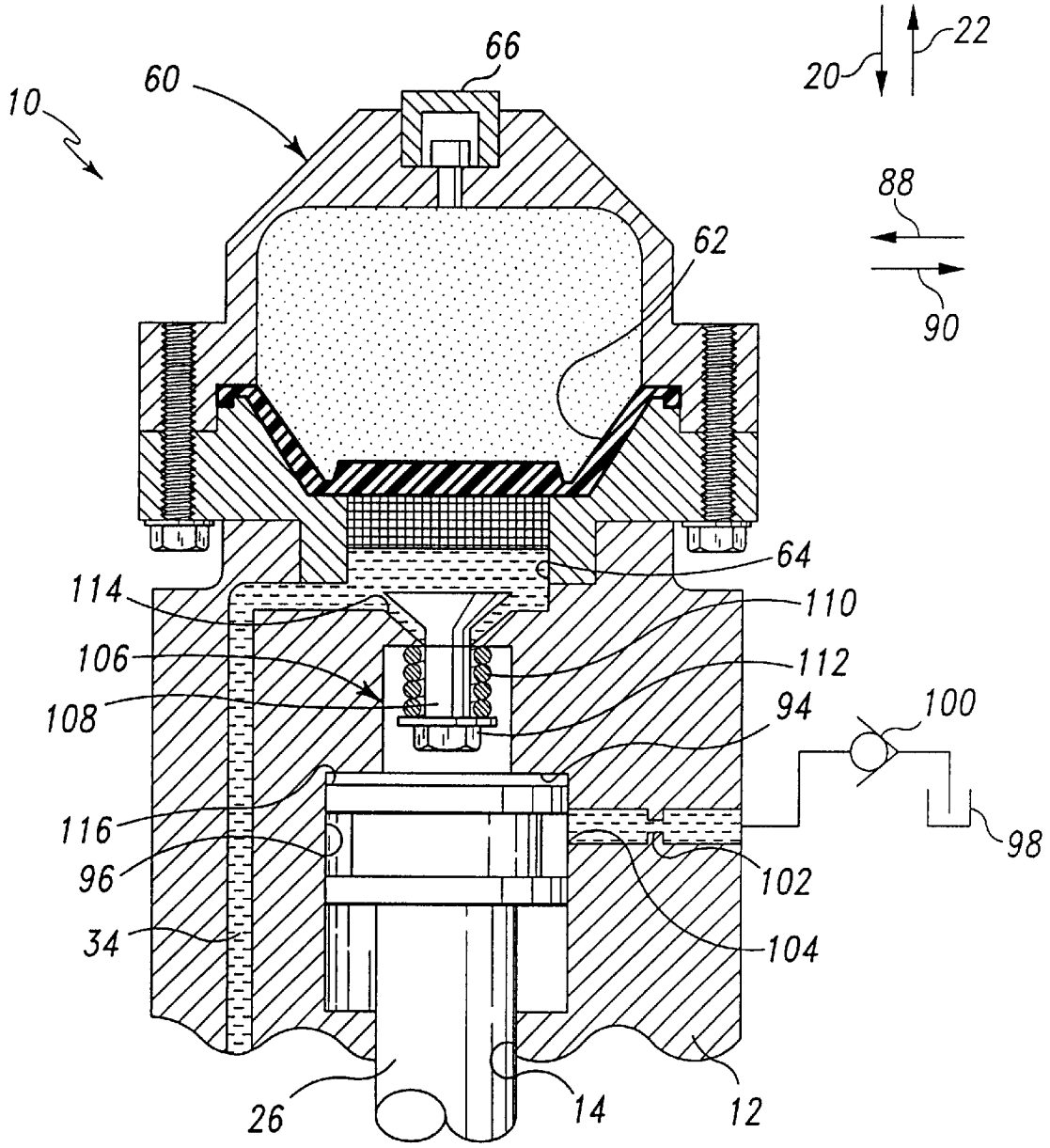
FIG. 3 is an enlarged cross sectional view of the load portion of the hammer assembly 10 of FIG. 1.
Figure 4:
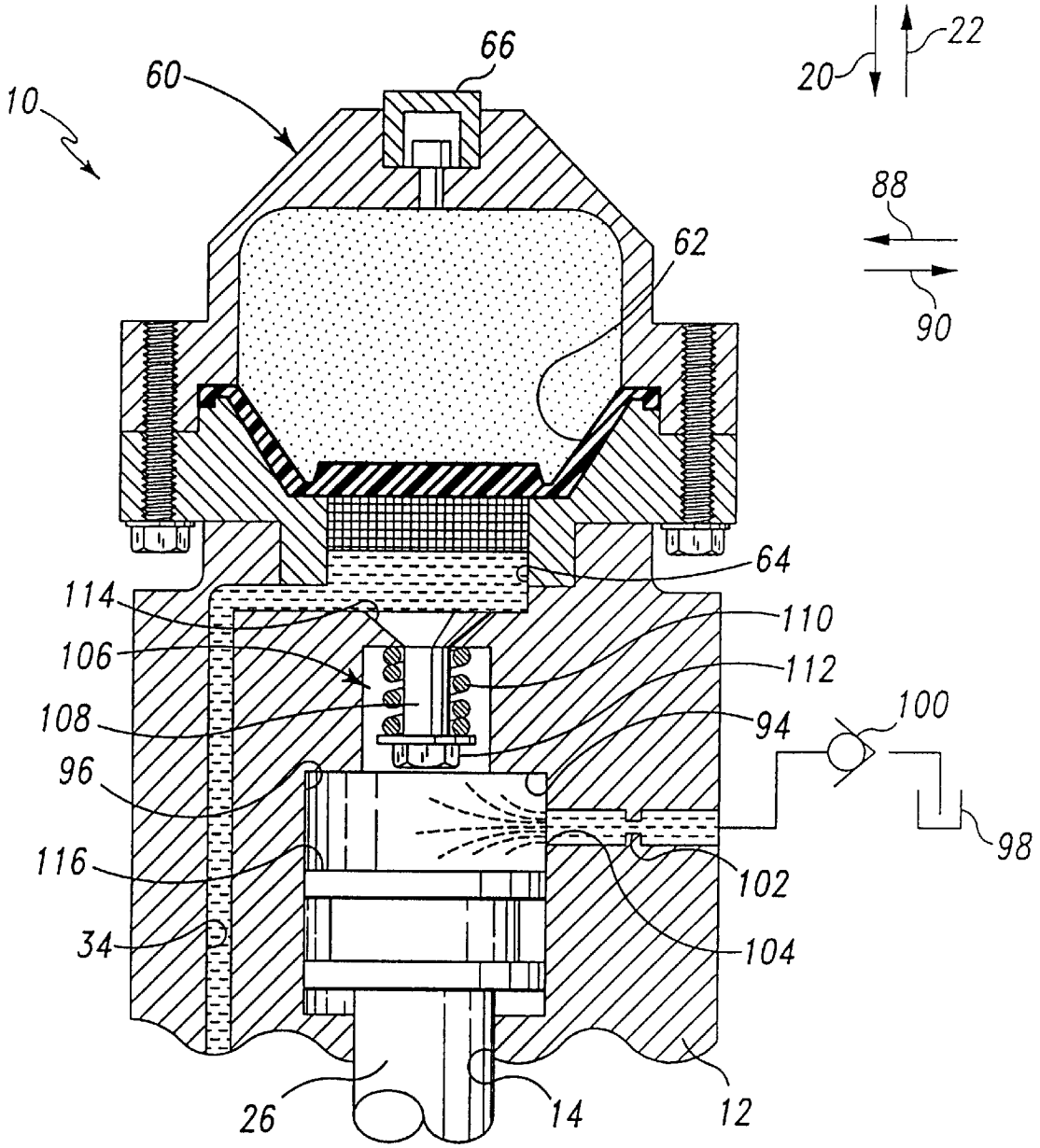
FIG. 4 is a view similar to FIG. 3, but showing the load portion of the hammer assembly 10 at the end of a work stroke.

Referring now to FIGS. 3 and 4, there is shown the load portion 26 of the piston 16. The load portion 26 reduces the severity of impact shocks created by the piston 16 striking the contact surface 94 of the housing 12.

During the work stroke, the piston 16 advances from the first piston position as shown in FIG. 3 to the second piston position as shown in FIG. 4 so as to draw damping fluid, such a hydraulic fluid, into a damping portion 96 of the chamber 14. In particular, movement of the piston 16 creates a partial vacuum in the damping portion 96 which advances the damping fluid from a source or sump 98 to the damping portion 96. More specifically, oil is advanced from the sump 98, through a check valve 100, past a restricting member 102, through an injector port 104, and into the damping portion 96 of the chamber 14.

The check valve 100 permits damping fluid to be advanced from the sump 98 to the damping portion 96 when the pressure in the sump 98 is greater than the pressure in the damping portion 96 and prevents damping fluid from being advanced from the damping portion 96 to the sump 98 when the pressure in the damping portion 96 is greater than the pressure in the sump 98. In particular, the check valve 100 allows damping fluid to be advanced from the sump 98 to the damping portion 96 during the work stroke, and prevents damping fluid from being advanced to the sump 98 from the damping portion 96 during the return stroke.

The restricting member 102 regulates the amount of damping fluid drawn from the sump 98 to the damping portion 96 of the chamber 14. In particular, the restricting member 102 is advantageously configured to advance a predetermined amount of damping fluid to the damping portion 96 via the injector port 104 during the work stroke. It should be appreciated that as the load portion 26 of the piston 16 creates a partial vacuum in the damping portion 96 of the chamber 14, the fluid that advances from the sump 98 through the restricting member 102 may be either in a liquid state, a gaseous state, or a mixture of the liquid and the gaseous states. Thus, at the end of the work stroke, the damping portion 96 is filled with a predetermined quantity of damping fluid.

During the return stroke, the load portion 26 advances from the second piston position as shown in FIG. 4 to the first piston position as shown in FIG. 3 so as to compress the damping fluid in the damping portion 96 of the chamber 14. It should be appreciated that the check valve 100 prevents the damping fluid in the damping portion 96 from advancing to the sump 98.

The fluid pressure in the damping portion 96 of the chamber 14 acts against an unloader valve assembly 106. The unloader valve assembly 106 includes a valve member 108, an unloader spring 110, and a spring retainer 112. The damping portion 96 of the chamber 14 further includes an exhaust port 114. The exhaust port 114 places the damping portion 96 in fluid communication with the area 64 of the accumulator 60. One end of the valve member 108 is positioned in the exhaust port 114 such that it can move in the general directions of arrows 20 and 22. An opposite end of the valve member 108 has a spring retainer 112 attached thereto. The unloader spring 110 in interposed between the housing 12 and the spring retainer 112. The bias force of the unloader spring 110 urges the valve member 108 in the general direction of arrow 20 thereby isolating the damping portion 96 of the chamber 14 from the area 64 of the accumulator 60.

As the load portion 26 of the piston 16 moves in the general direction of arrow 22, the damping fluid in the damping portion 96 is compressed. It should be appreciated that the compressed damping fluid in the damping portion 96 of the chamber 14 acts against an upper surface 116 of the load portion 26 of the piston 16. In particular, as the damping fluid is compressed, the force of damping fluid on the upper surface 116 increases, thereby slowing the velocity of the piston 116 in the general direction of arrow 22. It should further be appreciated, that reducing the velocity of the piston 16 in the general direction of arrow 22, decreases the severity of the impact shock generated when the piston 16 impacts the contact surface 94.

Moreover, the pressure of damping fluid in the damping portion 96 of the chamber 14 increases such that most of the damping fluid in the gaseous state in the damping portion 96 condenses into the liquid state. As the piston 16 continues to advance in the general direction of arrow 22, the higher density damping fluid in the liquid state continues to act on the upper surface 116. In particular, the damping fluid in the liquid state applies an even greater force on the upper surface 116 than the damping fluid in the gaseous state so as to further decrease the velocity of the piston 16 in the general direction of the arrow 22. It should be appreciated that further reducing the velocity of the piston 16 in the general direction of arrow 22, further decreases the severity of the impact shock generated when the piston 16 impacts the contact surface 94.

At the end of the return stroke, the pressure of damping fluid in the liquid state urges the unloader valve 106 from a closed position as shown in FIG. 4 to an open position as shown in FIG. 3. In particular, pressurized damping fluid in the liquid state in the damping portion 96 of the chamber 14 urges the valve member 108 in the general direction of arrow 22 whereas the spring bias force of the unloader spring 110 and the pressure of fluid in the accumulator area 64 urge the valve member 108 in the general direction of arrow 20. As the force of damping fluid in the damping portion 96 overcomes the bias force of the spring 110 and the force of fluid pressure in the area 64 acting on the valve member 108, the valve member 108 is urged in the general direction of arrow 22 so as to place the accumulator area 64 in fluid communication with the damping portion 96 of the chamber 14. It should be appreciated that high pressure damping fluid is advanced from the damping portion 96 to the area 64, thus necessitating additional damping fluid to be drawn from the sump 98 via the injector port 104 during the next work stroke. It should further be appreciated that pressure within the area 64 acts upon the accumulator bladder 62 thereby allowing additional hydraulic energy to be absorbed by the accumulator 60.

Industrial Applicability

In operation, the tip 46 of the work tool 18 is placed in contact with a hard object such as rock, concrete, or asphalt to be broken up. The control valve 32 places the pressure of the first hydraulic pressure source 28 in fluid communication with the passage 34 and the passage 36 to start the work stroke. High pressure fluid in passage 34 fills the area 38 and area 40 of the chamber 14. The high pressure fluid in area 40 acts on the shoulder 44 in order to drive the piston 16 in the general direction of arrow 20. Similarly, high pressure fluid in the area 38 acts on a shoulder 42 in order to drive the piston 16 in the general direction of arrow 20. High pressure fluid in the passage 36 fills the area 68 so as to urge the sleeve valve 58 in the general direction of arrow 22 thereby isolating the passage 72 from the passage 76.

As the piston 16 moves in the general direction of arrow 20, a partial vacuum is created in the damping portion 96 of the chamber 14 as shown in FIG. 3. This partial vacuum allows damping fluid to be advanced from the sump 98 to the damping portion 96 via the injector port 104. In particular, the damping fluid is advanced through the check valve 100 and past the restricting member 102 thereby allowing a predetermined quantity of damping fluid to be placed in the damping portion 96 of the chamber 14 during the work stroke.

At the end of the work stroke, the piston 16 strikes the work tool 18 so as to drive the work tool 18 in the general direction of arrow 20. The tip 46 of the work tool 18 is driven into the hard object in order to break up the hard object.

Also, at the end of the work stroke, the area 40 is placed in fluid communication with the area 50 as shown in FIG. 2. The high pressure fluid is then advanced to the area 50 and the passage 52 in fluid communication with the area 50. The high pressure fluid then advances to the area 54 where the high pressure fluid urges the surface 56 of the sleeve valve 58 in the general direction of arrow 20 so as to place the passage 72 in fluid communication with the passage 76 via the sleeve valve passage 74 defined in the sleeve valve 58.

To start a return cycle, the control valve 32 places pressure from the second hydraulic pressure source 30 in fluid communication with the passage 72. From the passage 72 high pressure fluid advances to the passage 76 via the sleeve valve passage 74. High pressure fluid in the passage 76 fills the area 78 of the chamber 14. The high pressure fluid in the area 78 acts on the shoulder 80 in order to drive the piston 16 in the general direction of arrow 22.

As the piston 16 moves in the general direction of arrow 22, the upper surface 116 of the piston 16 compresses the damping fluid in the damping portion 96 of the chamber 14. Compressing the vapor in the damping portion 96 decreases the velocity of the piston 16 in the general direction of arrow 22. Furthermore, as the damping fluid condenses in the damping portion 96, the damping fluid in the liquid state decreases the velocity of the piston 16 in the general direction of arrow 22. Moreover, at the end of the return stroke the pressure of damping fluid in the damping portion 96 overcomes the spring bias of the unloader spring 110 and the pressure of the fluid in the area 64 so as to advance damping fluid from the damping portion 96 to the area 64 of the accumulator 60. Advancing damping fluid to the area 64 of the accumulator 60 further reduces the hydraulic energy in the damping chamber 96, but requires that additional fluid be added to the damping portion 96 of the chamber 14 during the next work stroke in a manner similar to that described above.

The hammer assembly 10 repeats the above steps thereby causing the tip 46 to repeatably strike and break up the hard object. Each cycle requires the introduction of damping fluid into the damping chamber 96 via the injector port 104 during the work stroke, and the advancement of damping fluid through the unloader valve assembly 106 via the exhaust port during the return stroke. The damping fluid decreases the severity of the impact shock created as the piston 16 is driven into contact with the contact surface 94 of the housing 12.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A hammer assembly comprising:

a housing defining a chamber, said housing further defining an injector port and an exhaust port each being in fluid communication with said chamber;

a work tool positioned in said chamber;

a piston positioned within said chamber;

a first hydraulic pressure source which moves said piston in a work stroke toward said work tool;

a second hydraulic pressure source which moves said piston in a return stroke away from said work tool;

a damping fluid source in fluid communication with said injector port;

a first valve which (i) allows damping fluid to be advanced from said damping fluid source and into said chamber during said work stroke, and (ii) prevents damping fluid from being advanced from said damping fluid source and into said chamber during said return stroke; and a second valve which (i) allows damping fluid to be advanced out of said chamber through said exhaust port during said return stroke, and (ii) prevents damping fluid from being advanced into said chamber through said exhaust port during said work stroke.

2. The hammer assembly of claim 1, wherein:

said piston includes a load portion and a work portion, said first hydraulic pressure source causes work fluid to be advanced against said work portion so as to move said piston toward said work tool, said second hydraulic pressure source causes work fluid to be advanced against said work portion so as to move said piston away from said work tool, and said damping fluid opposes movement of said load portion during said return stroke.

3. The hammer assembly of claim 2, wherein said work fluid and said damping fluid each includes hydraulic oil.

4. The hammer assembly of claim 2, wherein:

said housing further defines an inlet port which is in fluid communication with said chamber, said first hydraulic pressure source is connected to said inlet port via a conduit, and said exhaust port is in fluid communication with said conduit.

5. The hammer assembly of claim 4, wherein damping fluid which is advanced out of said chamber through said exhaust port during said return stroke is commingled with said work fluid within said conduit.

6. The hammer assembly of claim 1, wherein said first valve and said second valve each is a check valve.

7. The hammer assembly of claim 6, wherein said first check valve is interposed between damping fluid source and said injector port.

8. The hammer assembly of claim 1, wherein:

said injector port includes a passage defined in said housing, and a restricting member is located within said passage whereby damping fluid which is advanced through said passage and into said chamber is vaporized.

9. A hammer assembly comprising:

a housing defining a chamber, said housing further defining an injector port and an exhaust port each being in fluid communication with said chamber;

a work tool positioned in said chamber;

a piston positioned within said chamber;

a first source of pressurized hydraulic fluid which moves said piston in a work stroke toward said work tool;

a second source of pressurized hydraulic fluid which moves said piston in a return stroke away from said work tool;

a damping hydraulic fluid source in fluid communication with said injector port;

a first check valve which (i) allows damping hydraulic fluid to be advanced from said damping hydraulic fluid source and into said chamber during said work stroke, and (ii) prevents damping hydraulic fluid from being advanced from said damping hydraulic fluid source and into said chamber during said return stroke; and a second check valve which (i) allows damping hydraulic fluid to be advanced out of said chamber through said exhaust port during said return stroke, and (ii) prevents damping hydraulic fluid from being advanced into said chamber through said exhaust port during said work stroke.

10. The hammer assembly of claim 9, wherein:

said piston includes a load portion and a work portion, said first source of pressurized hydraulic fluid causes hydraulic fluid to be advanced against said work portion so as to move said piston toward said work tool, said second source of pressurized hydraulic fluid causes hydraulic fluid to be advanced against said work portion so as to move said piston away from said work tool, and hydraulic fluid from said damping hydraulic fluid source opposes movement of said load portion during said return stroke.

11. The hammer assembly of claim 10, wherein:

said housing further defines an inlet port which is in fluid communication with said chamber, said first source of pressurized hydraulic fluid is connected to said inlet port via a conduit, and said exhaust port is in fluid communication with said conduit.

12. The hammer assembly of claim 11, wherein hydraulic fluid which is advanced out of said chamber through said exhaust port during said return stroke is commingled with said hydraulic fluid within said conduit.

13. The hammer assembly of claim 9, wherein said first check valve is interposed between said damping hydraulic fluid source and said injector port.

14. The hammer assembly of claim 9, wherein:

said injector port includes a passage defined in said housing, and a restricting member is located within said passage whereby hydraulic fluid which is advanced through said passage and into said chamber is vaporized.

15. A method of reducing vibrations in a hammer assembly which includes (i) a housing defining a chamber, the housing further defining an injector port and an exhaust port each being in fluid communication with the chamber, (ii) a work tool positioned in the chamber, (iii) a piston positioned within the chamber, (iv) a first hydraulic pressure source which moves the piston in a work stroke toward the work tool, (ii) a second hydraulic pressure source which moves the piston in a return stroke away from the work tool, (iv) a damping fluid source in fluid communication with the injector port, (v) a first valve which is interposed between the injector port and the damping fluid source, and (vi) a second valve which is in fluid communication with the exhaust port, comprising the steps of:

allowing damping fluid to be advanced from the damping fluid source and into the chamber during the work stroke via the first valve;

preventing damping fluid from being advanced from the damping fluid source and into the chamber during the return stroke via the first valve;

allowing damping fluid to be advanced out of the chamber through the exhaust port during the return stroke via the second valve; and preventing damping fluid from being advanced into the chamber through the exhaust port during the work stroke via the second valve.

* * * * *